US005223475A

United States Patent [19]

Bloodworth et al.

[11] Patent Number: 5,223,475

[45] Date of Patent: Jun. 29, 1993

[54] ACCEPTOR ELEMENT FOR THE THEMOSUABLIMATION PRINTING PROCESS

[75] Inventors: Robert Bloodworth; Wolfgang Podszun; Christian Lindner, all of Cologne; Karl-Erwin Piejko, Bergisch Gladbach, all of Fed. Rep. of Germany; Herman Uytterhoeven, Bonheiden, Belgium

[73] Assignee: Agfa-Gevaert Aktiengsellschaft, Leverkusen, Fed. Rep. of Germany

[21] Appl. No.: 700,557

[22] Filed: May 15, 1991

[30] Foreign Application Priority Data

May 29, 1990 [DE] Fed. Rep. of Germany ..... 4017246

[51] Int. Cl.[5] ..... B41M 5/035; B41M 5/38

[52] U.S. Cl. ..... 503/227; 428/195; 428/327; 428/521; 428/913; 428/914

[58] Field of Search ..... 8/471; 428/195, 521, 428/913, 914, 327; 503/227

[56] References Cited

U.S. PATENT DOCUMENTS 4,615,938 10/1986 Hotta et al. ..... 428/323

FOREIGN PATENT DOCUMENTS 0133011 7/1984 European Pat. Off. ..... 503/227

184242 7/1987 Japan ..... 503/227

*Primary Examiner*—B. Hamilton Hess

*Attorney, Agent, or Firm*—Connolly and Hutz

[57] ABSTRACT

In a dye acceptor element for the thermal dye sublimation printing process, containing a support and a dye acceptor layer consisting of a continuous phase and at least one disperse phase the dispersed phase is formed by a partially or completely cross-linked 1,3-dienehomo- or -co-polymer which has a solubility parameter of from 8 to 12 $(cal/cm^3)^{\frac{1}{2}}$. The disperse phase makes up 20 to 90% by weight of the sum of the continuous and disperse phases. The dye acceptor element is distinguished by high resolution, high brilliance and good long term stability.

6 Claims, No Drawings

ACCEPTOR ELEMENT FOR THE THEMOSUABLIMATION PRINTING PROCESS

The present invention relates to a dye acceptor element for thermal dye sublimation printing, also known as thermal dye diffusion transfer printing.

Numerous methods are available for making printouts of video stored or computer stored images. Among these, the thermal dye sublimation printing process has proved to be superior due to its advantages over other methods in meeting certain requirements. This recording method is based on thermally induced transfer of a dye from a dye donor layer to a dye acceptor layer and is described, for example, in "High Quality Image Recording by Sublimation Transfer Recording Material", Electronic Photography Association Documents, 27 (2), 1988 and the literature cited there. One particular advantage of this method is the possibility of fine gradation of the colour intensity.

The systems available at present do not, however, sufficiently satisfy the requirements for high colour density, sufficient image stability and high resolution. It is particularly difficult to achieve high colour density and sufficient image stability with minimum lateral diffusion of the dye.

An improved dye acceptor layer is described in EPA-133,011. This layer is diphasic, the disperse phase consisting of a polar polymer having a Tg of −100° to 20° C. while the continuous phase consists of a polymer which has a Tg of at least 40° C. and is immiscible with the polymer of the first phase. The disperse phase forms at least 15% of the surface. The sharpness of the images is limited due to the relatively large particle size of the disperse phase. Moreover, it is difficult to adjust the phase distribution and morphology as required.

U.S. Pat. No. 4,615,938 describes a dye acceptor sheet having a dye acceptor layer built up of polymers which are immiscible with one another and inorganic filler. This layer has a split structure and therefore insufficient mechanical strength.

JP-A-87-184242 discloses a dye acceptor sheet having an elastic interlayer of rubber material between the support and the dye acceptor layer. This interlayer is not used as dye acceptor layer.

It was an object of the present invention to provide a dye acceptor element for the thermal dye sublimation printing process which would be free from the disadvantages mentioned above. This problem is solved by using a special polymer in the dye acceptor element.

The invention therefore relates to a dye aceptor element for the thermal dye sublimation printing process comprising a support and a dye acceptor layer, in which the dye acceptor layer consists of an uncross-linked, continuous phase and at least one disperse phase, characterised in that the at least one disperse phase is formed by a partially or completely cross-linked 1,3-diene homo- or copolymer which has a solubility parameter of from 8 to 12 $(cal/cm^3)^{\frac{1}{2}}$ and amounts to 20 to 90% by weight of the sum of continuous and disperse phase and is immiscible with the continuous phase.

The polymer of the disperse phase preferably consists of particles having an average particle diameter of from 0.05 to 2 μm, in particular from 0.05 to 0.5 μm. The degree of cross-linking (gel content) is preferably from 5 to 100%, in particular from 30 to 100%. The polymer of the disperse phase preferably has a Tg below 60° C., preferably below 30° C.

The polymer of the disperse phase preferably consists to an extent of 40 to 100% by weight, in particular 60 to 100% by weight, of a 1,3-diene, e.g. 1,3-butadiene, isoprene, chloroprene or 1-fluoro-1,3-butadiene or mixtures of the aforesaid dienes.

The comonomers used are mainly vinyl monomers. The following are suitable vinyl monomers: Acrylonitrile, acrylates, methacrylates, malonates, fumarates, vinyl pyridine, styrene and styrene derivatives, particularly styrene derivatives substituted with halogen atoms, nitro groups, nitrile groups or amide or ester groups, such as 4-chlorostyrene, styrene sulphonic acid, styrene sulphonamides and styrene sulphonic acid esters. Other suitable monomers include esters of acrylic acid and methacrylic acid, in particular esters having 3 to 12 carbon atoms in the alcohol part, examples including n-butylacrylate, ethyl hexyl acrylate, decyl acrylate, hydroxyethyl acrylate, triethylene glycol monoacrylate, 2-methoxyethyl acrylate, N,N-dimethyl-aminoethyl meth-acrylate and N-methylamino ethyl methacrylate. Acrylamide and substituted acrylamides, vinyl esters such as vinyl acetate, vinyl propionate and vinyl laurate, vinyl chloride and vinylidene chloride may also be used. Acrylonitrile and methacrylonitrile are particularly suitable comonomers.

The choice of monomers is based on the required Tg values and solubility parameter. Tg values and solubility parameters of important homo- and copolymers and suitable methods of calculating them for new copolymer compositions are described in the literature (e.g. in Polymer Handbook, 3rd Edition, Brandrup and Immergut, John Wiley and Sons, New York, 1989).

The continuous phase preferably consists of a substantially uncross-linked polymer having a Tg>50° C. and a solubility parameter of from 8 to 14 $(cal/cm^3)^{\frac{1}{2}}$. Polymers, polycondensates and polyaddition products are suitable. The following are preferred polymers: Polyvinyl acetate, polyvinyl butyral, polyacrylic acid esters, polymethacrylic acid esters and copolymers of styrene and acrylonitrile. Polyesters are also suitable, in particular polyesters of aliphatic dicarboxylic acids, as well as polyamides and cellulose derivatives, e.g. cellulose propionate and cellulose acetobutyrate.

In one particular embodiment of the present invention, the disperse polymer phase and the continuous polymer phase are at least partly linked together by chemical bonds. In that case, the acceptor layer according to the invention has a particularly high stability. Linking of the disperse phase with the continuous polymer phase may be achieved, for example, by using particulate graft polymers having a core/shell structure. The core of these graft polymers consists of diene homo- or copolymers while the graft shell consists of the above-mentioned substances which are suitable as continuous polymer phase. Such grafted polydiene particles are known per se. Their preparation is described, for example, in Houben Weyl, Methoden der Organischen Chemie, Volume E20/Part 1, pages 673 et seq, and the literature cited there. Even if part of the continuous phase is covalently bound to the disperse phase and therefore a component of a cross-linked molecule, the polymer chains of the continuous phase are not cross-linked with one another. For the purpose of the invention, therefore, such polymers are regarded as uncross-linked even though covalently linked to the cross-linked phase. About 5 to 50% of the polymer chains of the continuous phase may be linked to the disperse phase.

The ratio by weight of disperse phase to continuous phase is preferably from 50:50 to 75:25. The dye acceptor layer in particular has a thickness of from 1 to 50 μm, preferably from 2 to 20 μm.

Suitable support materials for the acceptor layer include both paper, in particular synthetic paper, and films based on polyesters, polyamides or polycarbonates. The receptor element may, of course, contain not only the acceptor layer according to the invention and the support but also other layers known for this purpose. Thus it may be advantageous to apply an anti-sticking layer, for example of polysiloxane, over the acceptor layer. An interlayer, for example of gelatine, may be provided to improve the adherence of the acceptor layer to the support material.

The material according to the invention is prepared by mixing the disperse phase with the continuous phase or grafting it with the monomers of the continuous phase and applying the mixture or the graft polymer to the support by the usual methods such as application with a doctor blade or casting.

The dye acceptor element may be combined with a conventional dye donor element used for thermo-sublimation printing.

The colour images obtained are distinguished by high resolution, high brilliance and good long-term stability.

EXAMPLE

Dye acceptor layers having a wet thickness of 50 μm composed of mixtures of the emulsions A and B mentioned below in the given ratios by weight were cast on gelatine coated polyethylene paper. The coatings were dried at room temperature resulting in acceptor layers having a dry layer thickness of about 5 μm. An anti-stick layer of a 0.5% by weight solution of silicone oil in ethanol was applied to the acceptor layers in a wet thickness of 20 μm and dried at room temperature. All colour acceptor elements were tempered at 90° C. for 1 minute after being dried at room temperature.

Test images were produced on the above described receptor elements with a Hitachi VY100 Video Printer using the Hitachi dye cassette (VY-S100A). The colour intensity was determined by microdensitometry. The image stability was assessed optically after 3 days at 57° C. and 35% relative humidity.

TABLE 1

| Sample No. | Latex A | % by wt. latex[1] A | Latex B | % by wt. latex[1] B | Colour intensity | Image stability |
|---|---|---|---|---|---|---|
| 1 | A1 | 50 | B1 | 50 | 1.26 | good |
| 2 | A2 | 50 | B1 | 50 | 1.51 | good |
| 3[2] | A2 | 75 | B2 | 25 | 1.61 | good |
| 4 | A3 | 100 | — | — | 1.42 | good |
| 5 | A3 | 50 | B1 | 50 | 1.39 | good |

[1]Based on the sum of latex A and Latex B, dry

[2]A separate polyacrylic acid layer 2.5 μm in thickness was cast on the support before the colour acceptor layer Latex A1: Polybutadiene grafted with a copolymer of 72% by weight of styrene and 28% by weight of acrylonitrile; proportion of the polybutadiene in the graft polymer: 66% by weight.
Polybutadiene as in Latex A3
Tg of the copolymer: 101° C.
Solubility parameter of the copolymer, 11.3 $[cal/cm^3]^{\frac{1}{2}}$ Latex A2: Copolymer latex of 30% by weight of acrylo-nitrile and 70% by weight of butadiene
Tg: −13° C.
Solubility parameter: 10.0 $[cal/cm^3]^{\frac{1}{2}}$
Particle size: 150 nm
Degree of cross-linking: 90%

Latex A3: Polybutadiene grafted with 35% by wt. (based on the polybutadiene) of polymethylmeth-acrylate
Tg of polybutadiene: −58° C.
Solubility parameter of the polybutadiene; 8.5 $[cal/cm^3]^{\frac{1}{2}}$
Particle size of the polybutadiene: 130 nm
Degree of cross-linking of the polybuta-diene: 90%
Tg of the polymethylmethacrylate: 105° C.
Solubility parameter of the polymethyl-methacrylate: 10.3 $[cal/cm^3]^{\frac{1}{2}}$ Latex B1: Polyester of terephthalic acid and ethylene glycol
Tg: 72° C.
Solubility parameter: 10.1 $[cal/cm^3]^{\frac{1}{2}}$ Latex B2: Identical to Latex A1.

We claim:

1. Dye acceptor element for the thermal dye sublimation printing process, containing a support and a dye acceptor layer consisting of a continuous phase and at least one disperse phase, characterised in that the at least one disperse phase is formed by a 1,3-dienecopolymer which has a solubility parameter of from 8 to 12 $(cal/cm^3)^{\frac{1}{2}}$, a degree of crosslinking of from 30 to 100%, a Tg <30° C., consists of particles having an average particle diameter of from 0.05 to 2 μm and amounts to 20 to 90% by weight of the sum of continuous phase and disperse phase, and in that the continuous phase and disperse phase are at least partly linked together by chemical bonds.

2. Dye acceptor element according to claim 1, characterised in that the polymer of the disperse phase consists to an extent of 40 to 100% by weight of a 1,3-diene.

3. Dye acceptor element according to claim 1, characterised in that the continuous phase consists of a substantially uncross-linked polymer having a Tg>50° C. and a solubility parameter of from 8 to 14 $(cal/cm^3)^{\frac{1}{2}}$.

4. Dye acceptor element according to claim 1, characterised in that the ratio by weight of disperse phase to continuous phase is from 50:50 to 75:25.

5. Dye acceptor element for the thermal dye sublimation printing process, containing a support and a dye acceptor layer consisting of a continuous phase and at least one disperse phase, characterized in that the at least one disperse phase is formed by a 1,3-dienecopolymer which has a solubility parameter of from 8 to 12 $(cal/cm^3)^{\frac{1}{2}}$, a degree of crosslinking of from 30 to 100%, a Tg <30° C., consists of particles having an average particle diameter of from 0.05 to 2 μm and amounts to 20 to 90% by weight of the sum of continuous phase and disperse phase, and said continuous phase and said disperse phase being polymerized so that the continuous phase and the disperse phase are at least partly linked together by chemical bonds.

6. The dye acceptor element as claimed in claim 5, wherein the continuous phase and the disperse phase are at least partly linked by graft polymerization.

* * * * *